US009753419B2

(12) United States Patent
Kataoka et al.

(10) Patent No.: US 9,753,419 B2
(45) Date of Patent: Sep. 5, 2017

(54) FIXING DEVICE AND IMAGE FORMING APPARATUS CONFIGURED TO CHANGE THE PRESSING FORCE BETWEEN TWO NIP MEMBERS

(71) Applicant: KONICA MINOLTA, INC., Chiyoda-ku, Tokyo (JP)

(72) Inventors: Naoki Kataoka, Toyokawa (JP); Takeru Kinoshita, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/175,273

(22) Filed: Jun. 7, 2016

(65) Prior Publication Data

US 2016/0370744 A1 Dec. 22, 2016

(30) Foreign Application Priority Data

Jun. 22, 2015 (JP) ..... 2015-124735

(51) Int. Cl.
*G03G 15/20* (2006.01)

(52) U.S. Cl.
CPC ..... *G03G 15/2064* (2013.01); *G03G 15/2032* (2013.01)

(58) Field of Classification Search
CPC ..... G03G 15/2064; G03G 15/2017; G03G 15/2067; G03G 2215/2003
USPC ..... 399/329
See application file for complete search history.

(56) References Cited

U.S. PATENT DOCUMENTS 4,894,680 A * 1/1990 Hayakawa ..... G03B 27/32 355/400
2014/0294442 A1* 10/2014 Yoshikawa ..... G03G 15/2064 399/122

FOREIGN PATENT DOCUMENTS

JP 2011-154095 A 8/2011
JP 2012-177789 A 9/2012

OTHER PUBLICATIONS

Office Action ("Notification of Reason(s) for Refusal") dated Jun. 27, 2017 issued by the Japan Patent Office in corresponding Japanese Patent Application No. 2015-124735, and English language translation of Office Action (6 pages).

* cited by examiner

*Primary Examiner* — Billy Lactaoen
(74) *Attorney, Agent, or Firm* — Buchanan Ingersoll & Rooney PC

(57) ABSTRACT

A fixing device and an image forming apparatus to pass a paper through a nip portion between a fixing roller and a pressure roller and fix a toner image on the paper. The image forming apparatus includes a first spring and a second spring to press the pressure roller against the fixing roller and an operation lever to change a pressing state of the springs. The operation lever has two positions of: a first position in which pressing of the pressure roller by the first spring is made active and pressing by the second spring is made inactive; and a second position in which the pressing by the second spring is made active and the pressing by the first spring is made inactive. A contact pressure of the pressure roller against the fixing roller is differentiated in the first position and in the second position.

20 Claims, 7 Drawing Sheets

FIXING DEVICE AND IMAGE FORMING APPARATUS CONFIGURED TO CHANGE THE PRESSING FORCE BETWEEN TWO NIP MEMBERS

CROSS-REFERENCE TO RELATED APPLICATIONS

This application is based upon and claims the benefit of priority from the prior Japanese Patent Application No. 2015-124735, filed Jun. 22, 2015, the entire contents of which are incorporated herein by reference.

BACKGROUND OF THE INVENTION

Field of the Invention

The present invention relates to a fixing device to fix an unfixed toner image onto a recording medium in an image forming apparatus, and an image forming apparatus using the fixing device. To be more specific, the invention relates to a fixing device configured to change strength of a pressing force between two nip members (for example, rollers) which form a fixing nip, and an image forming apparatus using the fixing device.

Related Art

Heretofore, some image forming apparatuses are configured to change strength of a pressing force between nip members which form a fixing nip. Depending on types of a recording medium to be used, a preferable pressing force at the fixing nip differs. In one example of an image forming apparatus, there set two levels of strength of the pressing force. The stronger pressing force is adopted for a plain paper and the weaker pressing force is adopted for special recording media including an envelope.

Patent Document 1 discloses a fixing device enabled to switch the pressing force as mentioned above. The fixing device of the Patent Document 1 is provided with two springs to realize the pressing force in two levels. One of the springs is configured to continuously apply an elastic force on a fixing nip and the other one is configured to be switched its action and inaction of the elastic force. When the elastic forces of both the springs are applied, the pressing force is defined strong, and when the elastic force of only one spring is applied, the pressing force is defined weak.

RELATED ART DOCUMENTS

Patent Documents

Patent Document 1: JP-A-2012-177789

SUMMARY OF INVENTION

Problems to be Solved by the Invention

The above mentioned conventional technique has the following problem. The problem is large variations in strong pressing force among individual devices. The strong pressing force is too strong in some devices but not enough in some other devices. As a result, a fixing performance of a toner image and a conveying operation of a recording medium in a fixing device cannot be achieved as expected in some individuals.

The present invention has been made in view of the circumstances to solve the above problem and has a purpose to provide a fixing device enabled to change a pressing force between nip members forming a fixing nip and to obtain an aimed pressing force for each level at high precision, and to provide an image forming apparatus using such a fixing device.

Means of Solving the Problems

To achieve the above purpose, one aspect of the invention provides a fixing device including a first nip member and a second nip member pressed against the first nip member, the fixing device being configured to pass a recording medium carrying a toner image thereon through a nip portion formed by the first nip member and the second nip member and to fix the toner image on the recording medium, wherein the fixing device further includes: a first elastic member and a second elastic member to press the second nip member against the first nip member; and an operation lever to change a pressing state of the second nip member against the first nip member by the first elastic member and the second elastic member, the operation lever is configured to be switchable in positions of: a first position in which the first elastic member is made operative to press the second nip member and the second elastic member is made non-operative, and a second position in which the second elastic member is made operative to press the second nip member and the first elastic member is made non-operative, and a pressing force of the second nip member against the first nip member in the first position is different from a pressing force of the second nip member against the first nip member in the second position.

In the fixing device with the above configuration, the recording medium passes through the nip portion between the first nip member and the second nip member, and thus the toner image is fixed. The nip portion is subjected to a pressing force by the first elastic member or the second elastic member to press the second nip member against the first nip member. The fixing device includes the operation lever to change a pressing state of the first elastic member and the second elastic member. To be specific, the operation lever has two positions of a first position and a second position. In the first position, the first elastic member applies the elastic force, but the second elastic member does not apply the elastic force. On the other hand, in the second position, the second elastic member applies the elastic force, but the first elastic member does not apply the force. The pressing forces to press the second nip member against the first nip member are different in the two positions, and therefore two levels of the pressing force are applicable. A precision of the pressing force in the first position is determined only by the precision of the elastic force of the first elastic member, and a precision of the pressing force in the second position is determined only by the precision of the elastic force of the second elastic member. Accordingly, variations in the pressing force of both the elastic members are not added, preventing decline in the precision of the pressing force.

Effects of the Invention

According to the present configuration, there are provided a fixing device enabled to change a pressing force of nip members forming a fixing nip and obtain high precision in each level of the pressing forces, and an image forming apparatus using the fixing device.

DESCRIPTION OF EMBODIMENTS

Figure 1:
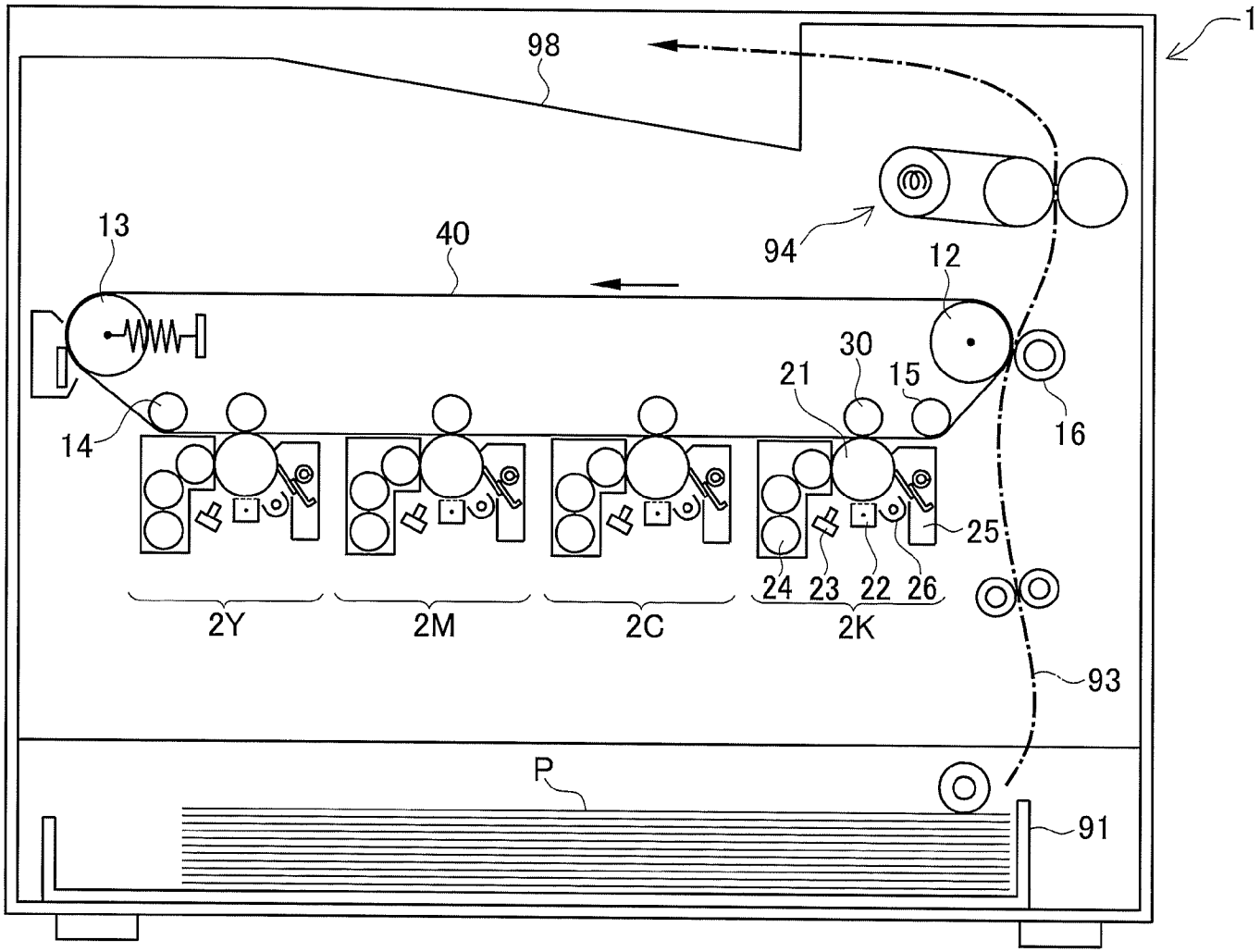
FIG. 1 is a sectional view of an image forming apparatus according to an embodiment.

A detailed description of a preferred embodiment of the present invention will now be given referring to the accompanying drawings. FIG. 1 is a view illustrating a configuration example of an image forming apparatus according to the present invention. An image forming apparatus 1 shown in FIG. 1 is a tandem electrophotographic digital color printer (hereinafter, simply described as a "printer"). Other than a printer, the present invention is unquestionably applicable to a multifunction printer including a scanner, a multifunction apparatus having functions of a printer and a scanner, and the like.

The image forming apparatus 1 is provided with an intermediate transfer belt 40 in an almost center portion inside the apparatus. The intermediate transfer belt 40 is hung around a drive roller 12, a tension roller 13, and driven rollers 14 and 15. The intermediate transfer belt 40 is configured to rotate in a counter-clockwise direction in FIG. 1 in association with rotation of the drive roller 12. Under the intermediate transfer belt 40, four imaging units 2Y, 2M, 2C, and 2K each corresponding to colors of yellow (Y), magenta (M), cyan (C), and black (K) are placed. The imaging unit 2K includes a photoconductor 21, a charging device 22, an exposing device 23, a developing device 24, a cleaning device 25, an eraser (an image erasing device) 26, and a primary transfer roller 30. Each of the imaging units 2Y, 2M, and 2C has the same configuration with the imaging unit 2K. These imaging units are thus configured to form a full-color toner image on the intermediate transfer belt 40. Further, a secondary transfer roller 16 is press-contacted with a portion supported by the drive roller 12 on the intermediate transfer belt 40.

In a lower part of the image forming apparatus 1, a sheet feeding cassette 91 is removably disposed. A paper P is taken out one by one from the sheet feeding cassette 91 and supplied to the secondary transfer roller 16 through a conveying path 93. The paper P supplied to the secondary transfer roller 16 is transferred with a toner image. A fixing unit 94 is placed downstream of the secondary transfer roller 16 (in an upper portion in FIG. 1) on the conveying path 93. The fixing unit 94 is a device to fix an unfixed toner image on the paper P. On a further downstream side of the fixing unit 94, a discharging tray 98 is provided.

Figure 2:
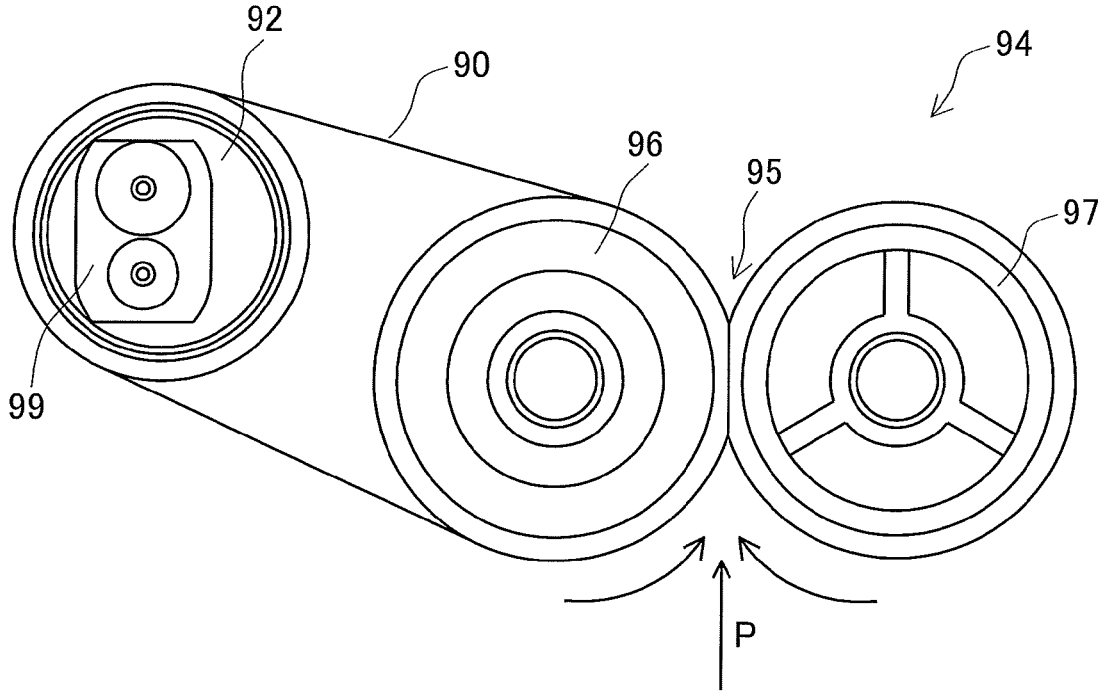
FIG. 2 is a sectional view of a fixing device in the image forming apparatus shown in FIG. 1.

The fixing unit 94 is now explained. FIG. 2 is a sectional view of the fixing unit 94. As shown in FIG. 2, the fixing unit 94 includes a pressure roller 97, a fixing roller 96, and a heating roller 92. The pressure roller 97 and the fixing roller 96 are press-contacted each other to form a fixing nip 95. A fixing belt 90 is hung around the fixing roller 96 and the heating roller 92. The heating roller 92 includes a heater 99. The heater 99 is a heating member such as a halogen lamp, for example. By passing through the fixing nip 95, the unfixed toner image is fixed on the paper P.

In the image forming apparatus 1, the fixing roller 96 and the heating roller 92 are fixed in their positions. On the other hand, the pressure roller 97 is movable to change strength of a pressing force between the pressure roller 97 and the fixing roller 96. Further, the pressure roller 97 needs to be movable so that the press-contact state can be released in case the paper P gets jammed. This movable mechanism of the pressure roller 97 is explained with reference to FIG. 3 and the following figures.

Figure 3:
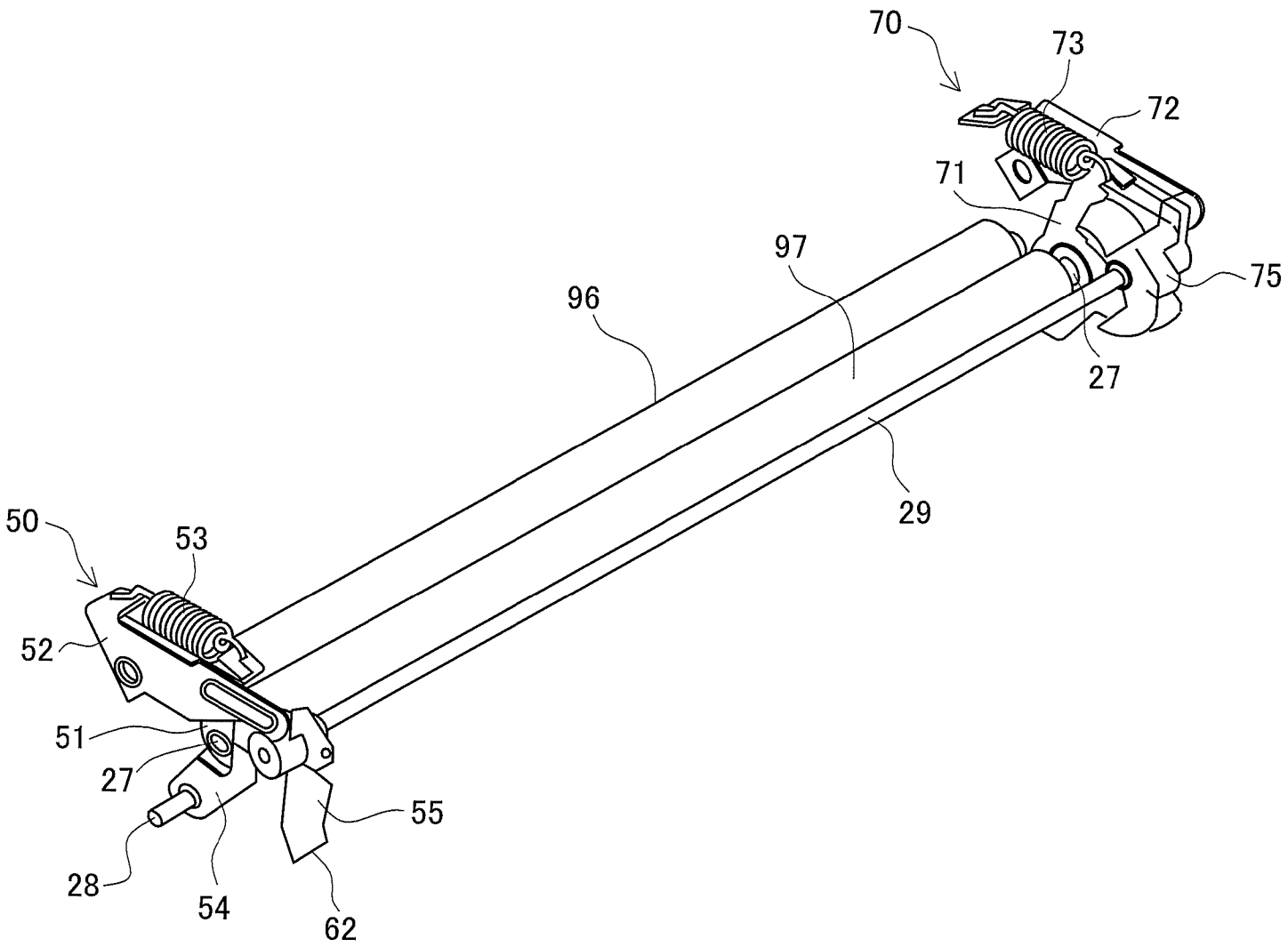
FIG. 3 is a perspective view of a pressure roller and a fixing roller in the fixing device in FIG. 2.

FIG. 3 is a perspective view of the pressure roller 97 and the fixing roller 96. In FIG. 3, the heating roller 92 and the fixing belt 90 illustrated in FIG. 2 are omitted. As shown in FIG. 3, a holding mechanism 50 and a holding mechanism 70 rotatably support both ends of the pressure roller 97. The holding mechanism 50 and the holding mechanism 70 are configured in an almost reflection symmetry. A shaft 27 of the pressure roller 97 is supported by first movable members 51 and 71 in the holding mechanisms 50 and 70. Both the first movable members 51 and 71 are provided rotatably about a support rod 28. The support rod 28 is statically provided in the image forming apparatus 1 in parallel with the pressure roller 97 and the fixing roller 96. Rotation movement of the first movable members 51 and 71 about the support rod 28 changes strength of the pressing force of the pressure roller 97 to the fixing roller 96 or releases the press-contact state. Herein, a rotation angle of the first movable members 51 and 71 may not be large.

The holding mechanisms 50 and 70 are, respectively, further provided with second movable members 52 and 72, first springs 53 and 73, third movable members 54 and 74 (the third movable member 74 is not illustrated in FIG. 3), and operation members 55 and 75. These and other components will be explained in order. The operation member 55 and the operation member 75 are coupled by a coupling rod 29 to be integrally operated. The coupling rod 29 is statically provided in the image forming apparatus 1 in parallel with the pressure roller 97 and the fixing roller 96. The operation member 55 is provided with a lever portion 62 for manual operation. The operation member 75 is not provided with the lever portion 62. The operation member 55 including the lever portion 62, the coupling rod 29, and the operation member 75 as a whole constitute an operation lever.

Figure 4:
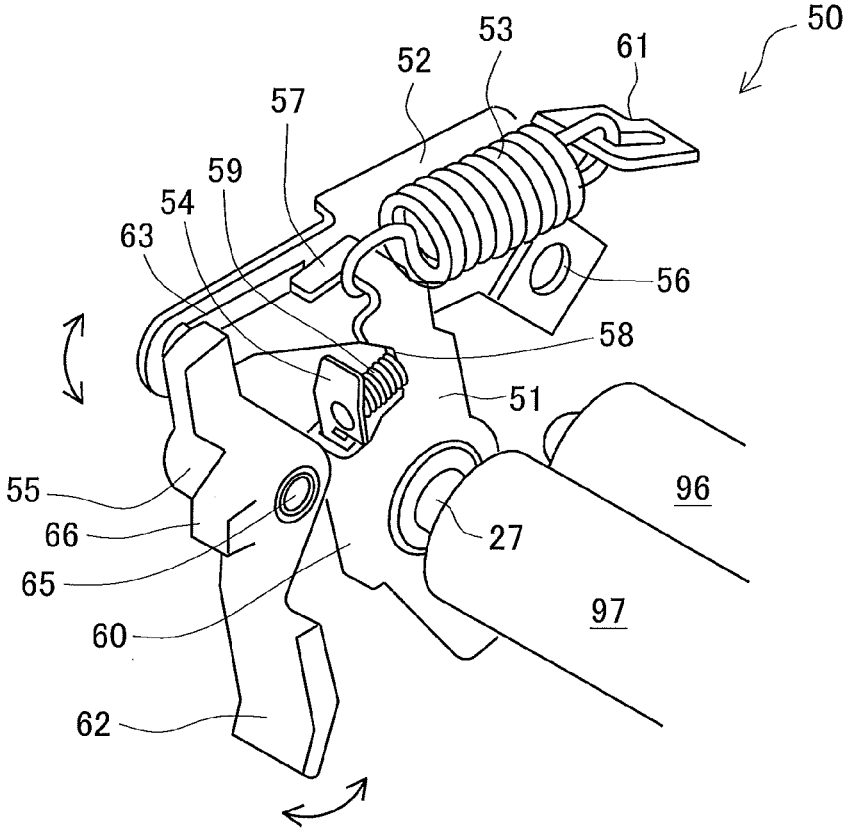
FIG. 4 is a perspective view of a holding mechanism holding one end of the fixing roller, showing the inside of the holding mechanism in a widthwise direction.
Figure 5:
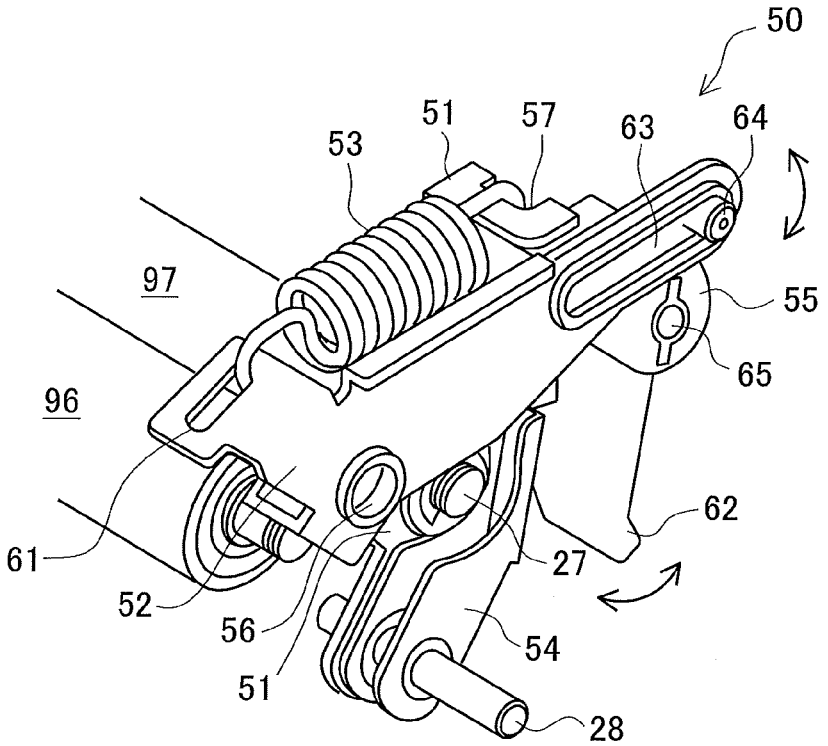
FIG. 5 is a perspective view of the holding mechanism holding one end of the fixing roller, showing the outside of the holding mechanism in the widthwise direction.

The holding mechanism 50 and the holding mechanism 70 are similarly configured (configured in an almost reflection symmetry as mentioned above) except the presence or absence of the lever portion 62 in the operation members 55 and 75. The holding mechanism 50 is further explained in detail with reference to the perspective views of FIGS. 4 and 5. As shown in FIGS. 4 and 5, the first movable member 51 is provided with a spring hook 57. The second movable member 52 is provided with a spring hook 61. Both ends of the first spring 53 are hooked on those spring hooks 57 and 61. Further, the second movable member 52 is provided with a fulcrum 56. The fulcrum 56 is placed in a fixed position in the image forming apparatus 1. The second movable member 52 is configured to rotatably move about this fulcrum 56. Rotation movement of the second movable member 52 changes a distance between the spring hook 57 and the spring hook 61.

To operate the second movable member 52 to rotate, the second movable member 52 is provided with a long hole 63. Further, the operation member 55 is provided with a projecting portion 64. The projecting portion 64 is fitted in the long hole 63. Thus, movement of the operation member 55 brings the projecting portion 64 to move in the long hole 63 so that the second movable member 52 is rotated. The operation member 55 is further provided with a rod mounting hole 65. The above mentioned coupling rod 29 is not illustrated in FIGS. 4 and 5, but is mounted in this rod mounting hole 65. Accordingly, the operation member 55 rotates about the rod mounting hole 65. The operation member 55 is rotated by manual operation of the lever portion 62.

The above configuration allows the first spring 53 to be in one state of maintaining its free length and in the other state of being elongated from its free length. In the former state, the first movable member 51 is not subjected to the elastic force of the first spring 53, but in the latter state, the first movable member 51 is pulled by the first spring 53 with its elastic force. A pulling direction coincides with a direction in which the pressure roller 97 is pushed to the fixing roller 96. This state in which the pressure roller 97 is pushed to the fixing roller 96 by the tension of the first spring 53 is defined as a first pressing state.

The first movable member 51 is further provided with a spring seat 58. A second spring 59 is held between the spring seat 58 and the third movable member 54 and contracted from its free length. The second spring 59 is placed in an almost circumferential direction about the support rod 28 of the first movable member 51. The spring seat 58 is placed on a side close to the fixing roller 96 with respect to the second spring 59, and the third movable member 54 is placed on an opposite side from the fixing roller 96. In other words, the third movable member 54 is located far from the fixing roller 96 far more than at least the spring seat 58 of the first movable member 51. The first movable member 51 is further provided with a wall portion 60. The wall portion 60 is located far more than the third movable member 54 from the fixing roller 96.

Consequently, the third movable member 54 is placed between the spring seat 58 and the wall portion 60, and the second spring 59 is held between the third movable member 54 and the spring seat 58.

Thus, as long as there is no any special reason, the third movable member 54 is pressed against and stationed at the wall portion 60 by the elastic force of the second spring 59. In this state, the elastic force of the second spring 59 acts on the spring seat 58 and the wall portion 60, and this elastic force is kept in balance between the spring seat 58 and the wall portion 60 inside the first movable member 51. Therefore, the elastic force of the second spring 59 in this state is not exerted on the first movable member 51 to move.

On the other hand, the operation member 55 is provided with a protrusion 66. When the operation member 55 largely rotates, the protrusion 66 pushes the third movable member 54. This pushing force acts in a direction to further compress the second spring 59. By this compression, the elastic force of the second spring 59 is not applied to the wall portion 60 in the first movable member 51 but only applied to the spring seat 58. As a result, the first movable member 51 is pushed by the elastic force of the second spring 59. The direction of pushing coincides with the direction in which the pressure roller 97 is pressed to the fixing roller 96. This state in which the pressure roller 97 is pressed to the fixing roller 96 by pushing of the second spring 59 is defined as a second pressing state. Herein, the pressing force of the pressure roller 97 against the fixing roller 96 is larger in the first pressing state than in the second pressing state.

In the first movable member 51, both the spring hook 57 and the spring seat 58 are placed radially outside the shaft 27 of the pressure roller 97 with respect to the support rod 28. Namely, a radial moving direction of each of the spring hook 57 and the spring seat 58 from the support rod 28 is longer than that of the shaft 27. Therefore, the first spring 53 and the second spring 59 may not be made excessively strong.

Figure 6:
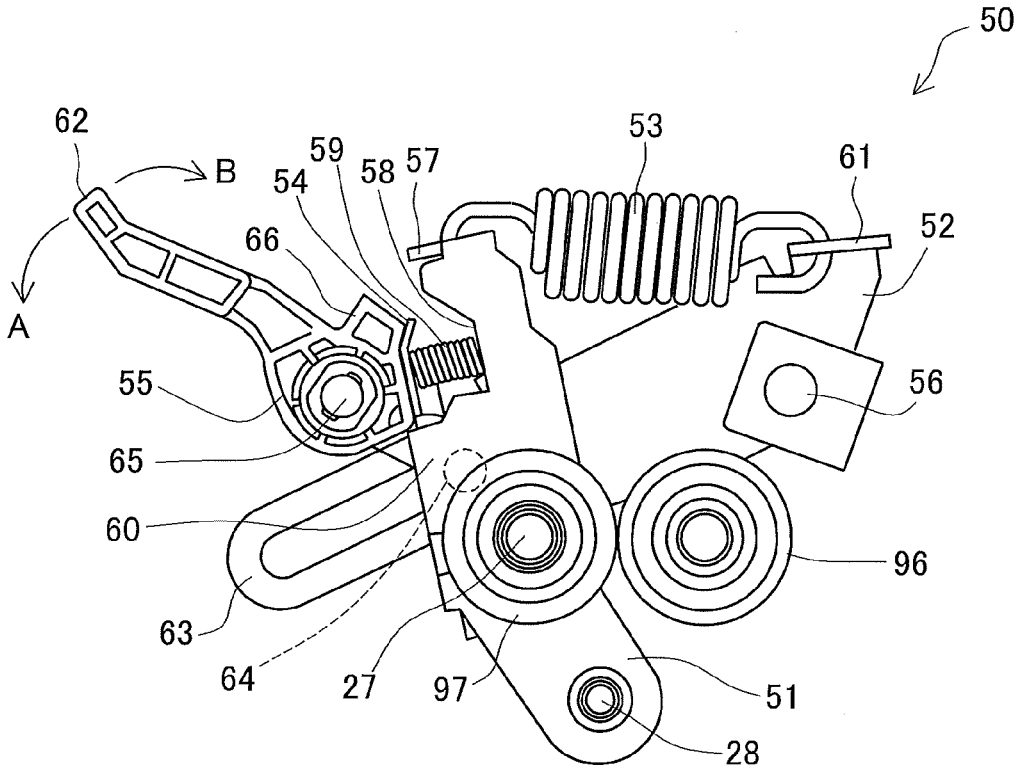
FIG. 6 is a back side view of the holding mechanism shown in FIGS. 4 and 5 when the mechanism is seen from a rear side in the image forming apparatus (in a neutral state)
Figure 7:
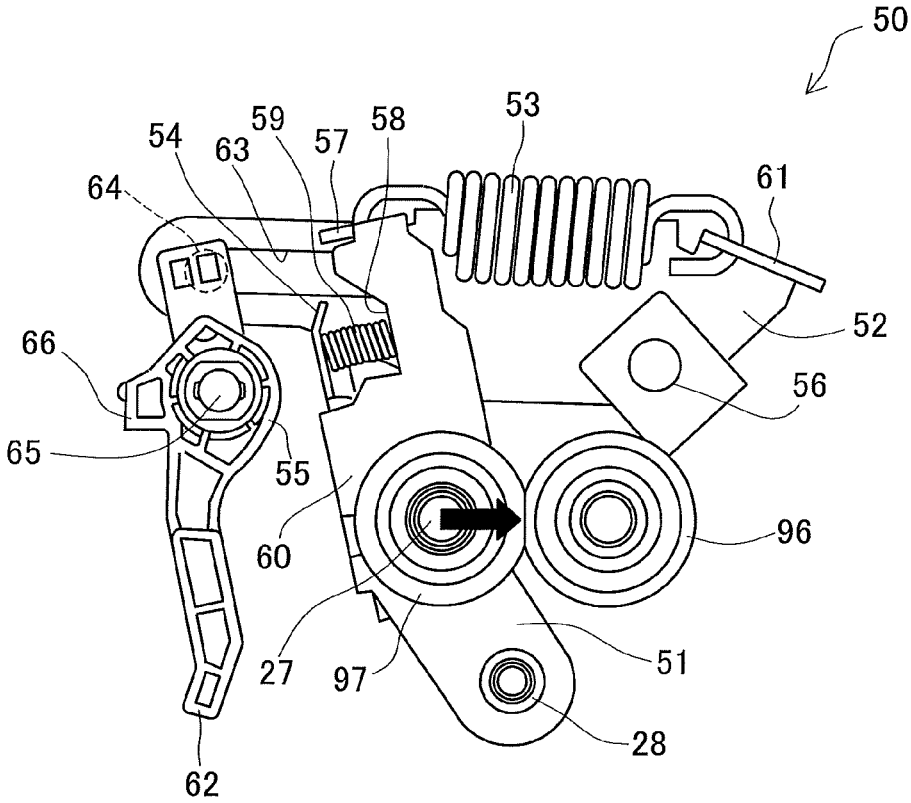
FIG. 7 is a back side view of the holding mechanism seen from the rear side (in a first pressing state)
Figure 8:
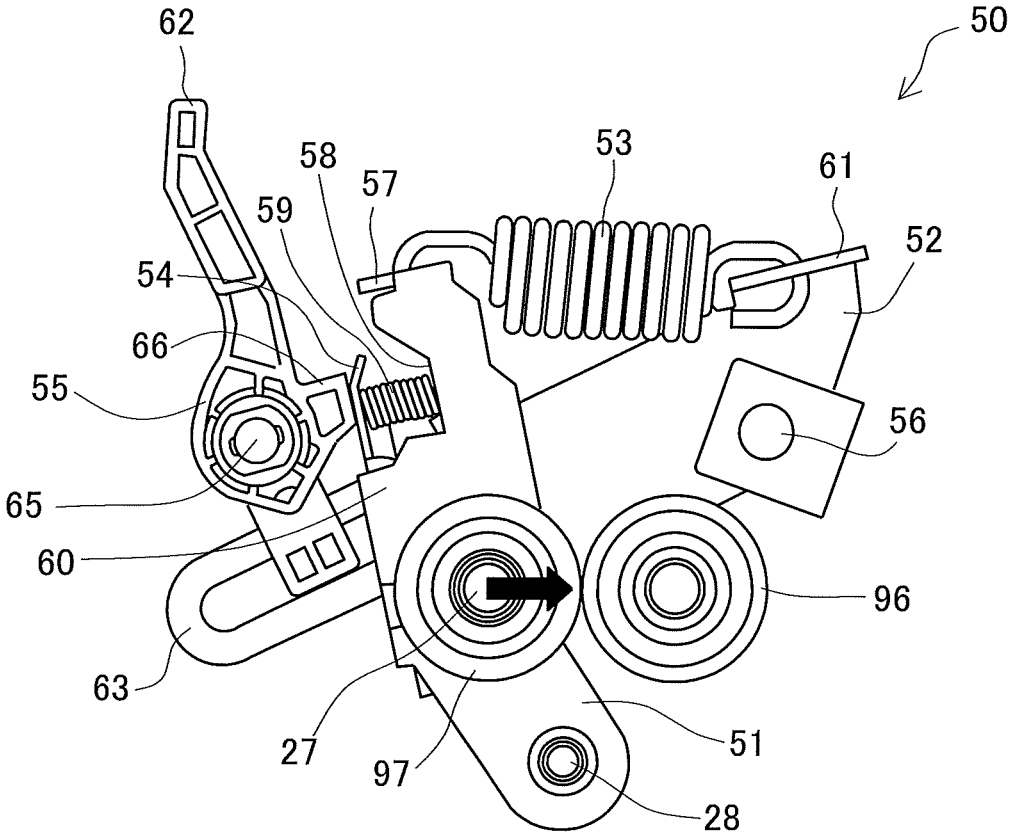
FIG. 8 is a back side view of the holding mechanism seen from the rear side (in a second pressing state)

Operation of the holding mechanism 50 and the holding mechanism 70 configured above is explained with reference to FIGS. 6 to 8. These drawings illustrate the holding mechanism 50 which is seen from a side of the pressure roller 97 and the fixing roller 96. In other words, the drawings are back side views of the holding mechanism 50 when the mechanism 50 is seen from a rear side of the image forming apparatus 1. FIGS. 6 to 8 are different from one another depending on positions of the operation member 55.

FIG. 6 shows a state in which the operation member 55 is in a median position in its movable range. In this state, the first movable member 51 is free from pressing by any one of the first spring 53 and the second spring 59. In other words, the first spring 53 is not elongated from its free length, and the elastic force of the second spring 59 is made inactive by the contact of the third movable member 54 with the wall portion 60. In the state shown in FIG. 6, therefore, there is applied only little pressing force between the pressure roller 97 and the fixing roller 96. When the holding mechanism 50 is in such a state, the holding mechanism 70 is also in the similar state. This state is defined as a neutral state, and a position of the lever portion 62 in the state is defined as a neutral position. The lever portion 62 is operable to move in a direction indicated with an arrow A or a direction indicated with an arrow B from the neutral position.

When the lever portion 62 is operated to move in the arrow A direction from the state shown in FIG. 6, the holding mechanism 50 is positioned in a state shown in FIG. 7. In the state of FIG. 7, the operation member 55 including the lever portion 62 is in a position rotated nearly 180 degrees in a counter-clockwise direction about the rod mounting hole 65 (the coupling rod 29) from the state shown in FIG. 6. In association with this rotation of the operation member 55, a position of the projecting portion 64 is largely different in FIG. 6 and in FIG. 7. Specifically, the position of the projecting portion 64 is higher in FIG. 7 than in FIG. 6. As a result, the state of the second movable member 52 is also different in FIG. 6 and in FIG. 7. In the second movable member 52 in FIG. 7, the long hole 63 is largely lifted up by the projecting portion 64 from the state shown in FIG. 6. Accordingly, the second movable member 52 in FIG. 7 is, as compared with the second movable member 52 in FIG. 6, rotated in a clockwise direction about the fulcrum 56 in the figure. Herein, an operation force to operate the lever portion 62 to the arrow A direction is not so large because the first spring 53 is not so strong as mentioned above.

Therefore, the spring hook 61 of the second movable member 52 in FIG. 7 is, as compared with the state in FIG. 6, positioned slightly far from the spring hook 57 of the first movable member 51. Accordingly, the first spring 53, which has not been elongated from its free length in FIG. 6, is elongated from its free length in FIG. 7. Thus, unlike the state in FIG. 6, the first movable member 51 in FIG. 7 is urged by contraction of the first spring 53. Therefore, in FIG. 7, the pressure roller 97 and the fixing roller 96 are subjected to the pressing force.

As for the second spring 59, a state shown in FIG. 7 is same as the state shown in FIG. 6. In the state shown in FIG. 7, only the pressing force generated by the first spring 53 is applied to the pressure roller 97 and the fixing roller 96. The elastic force of the second spring 59 is not applied here. Further, even if an operator releases his hand from the lever portion 62 in the state in FIG. 7, the lever portion 62 does not return to a position in FIG. 6 by itself but remains in a position shown in FIG. 7. When the holding mechanism 50 is in this state, the holding mechanism 70 is also in the similar state. This state is appropriate for performing image forming with an ordinarily used printing paper as a paper P (a recording medium). Therefore, usual image forming is performed in this state. This state is the first pressing state, and the position of the lever portion 62 in the state is defined as a first position. The holding mechanism 50 shown in FIGS. 4 and 5 is also in this first pressing state.

When the lever portion 62 is operated in the arrow B direction from the state in FIG. 6, the holding mechanism 50 is positioned in a state shown in FIG. 8. In the state of FIG. 8, the operation member 55 including the lever portion 62 is slightly rotated clockwise about the rod mounting hole 65 (the coupling rod 29) in the figure from the state in FIG. 6. Accordingly, in the state in FIG. 8, the protrusion 66 of the operation member 55 is positioned to face the third movable member 54. This is a distinguishable feature of the state in FIG. 8 since the protrusion 66 does not face the third movable member 54 in FIGS. 6 and 7. Therefore, as compared with the state in FIG. 6, the second spring 59 is further contracted in the state in FIG. 8. This is because the third movable member 54 is pushed by the protrusion 66 against the spring seat 58 of the first movable member 51. Herein, an operation force required to operate the lever portion 62 in the arrow B direction is not so strong because the second spring 59 is not so strong as mentioned above.

As a result, in the state in FIG. 8, the third movable member 54 is separated from the wall portion 60 of the first movable member 51. In short, the elastic force of the second spring 59 to elongate is applied to the spring seat 58 of the first movable member 51 on one end side, but on the other end side, the force is not applied to the wall portion 60 of the first movable member 51 in the state in FIG. 8. This is because the protrusion 66 receives the urging force of the second spring 59 on the other end side via the third movable member 54. Thus, the first movable member 51 in FIG. 8 is, unlike the state in FIG. 6, urged by the elastic force of the second spring 59. As a consequence, the pressure roller 97 and the fixing roller 96 are subjected to the pressing force, but the pressing force is weaker than that in the state in FIG. 7.

Also in the state in FIG. 8, the first spring 53 keeps its free length as similar to the state in FIG. 6. Namely, the pressure roller 97 and the fixing roller 96 are only subjected to the pressing force generated by the second spring 59 in the state in FIG. 8. The elastic force of the first spring 53 is not exerted in this state. Further, even if the operator releases his hand from the lever portion 62 in the state in FIG. 8, the lever portion 62 does not return to the state in FIG. 6 by itself but remains in a position in FIG. 8. When the holding mechanism 50 is in this state, the holding mechanism 70 is also in the similar state. This state in FIG. 8 is appropriate for forming an image on a special recording medium such as an envelope, not an ordinarily used printing paper. Therefore, this state is chosen when image forming is performed for such a special recording medium. This is the second pressing state, and a position of the lever portion 62 in this state is defined as a second position.

The neutral state in FIG. 6 is appropriate for a case of removing a jammed paper P when the paper P gets jammed in the fixing unit 94. When a paper jamming occurs during image forming in the first pressing state in FIG. 7, the lever portion 62 is operated to bring the state into the neutral state in FIG. 6 without going through the second pressing state in FIG. 8. As similarly, when the position of the holding mechanism 50 is switched from the second pressing state in FIG. 8 to the neutral state in FIG. 6, the mechanism 50 does not go through the first pressing state in FIG. 7. This is because the lever portion 62 in the neutral position is located between the first position and the second position.

As mentioned above, both the second movable member 52 and the third movable member 54 are in the non-operative positions in the state in FIG. 6, and in the state in FIG. 7, only the second movable member 52 is switched to be in the operative position and the third movable member 54 remains in the non-operative position. In the state in FIG. 8, similarly, only the third movable member 54 is switched to be in the operative position and the second movable member 52 remains in the non-operative position.

In each of the above mentioned first pressing state and the second pressing state, the elastic force of either only one of the first spring 53 and the second spring 59 contributes to press-contact of the pressure roller 97. The elastic forces of both the first spring 53 and the second spring 59 do not contribute to the press-contact at the same time. Therefore, in each of the first pressing state and the second pressing state, individual precision of either one of the first spring 53 and the second spring 59 is reflected on the precision of the pressing force between the pressure roller 97 and the fixing roller 96. In other words, variations in each of the first spring 53 and the second spring 59 are not added, and do not contribute to the variation of the pressing force as their sum. Thus, the precision of the pressing force is high. In the image forming apparatus 1 of the present embodiment, accordingly, in each of the first pressing state and the second pressing state, abnormality in the pressing force hardly occurs in the fixing nip. As a result, creases and flip-up of a rear end of the paper hardly occur.

Figure 9:
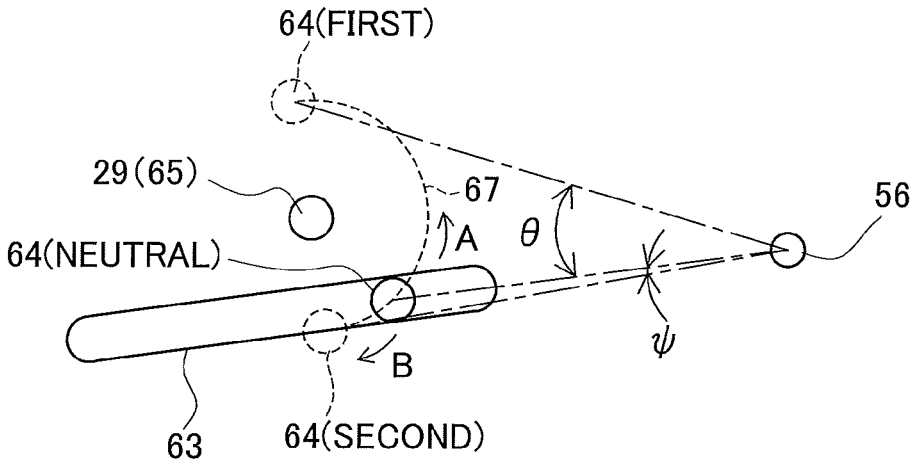
FIG. 9 is a schematic diagram showing a relation between a long hole of a second movable member and a track of a projecting portion of an operation member.

It is now explained in detail with reference to FIG. 9 the reason why the first spring 53 maintains its free length without being elongated when the lever portion 62 is switched from the neutral position in FIG. 6 to the second position in FIG. 8. FIG. 9 shows a position of the long hole 63 of the second movable member 52 in the neutral state and positions of the projecting portion 64 of the operation member 55 in each state. A track 67 of the projecting portion 64 depicted by operation of the lever portion 62 is a circular arcuate shape about the coupling rod 29 (the rod mounting hole 65). In the figure, a direction A to move the projecting portion 64 from the neutral position to the first position and a direction B to move the projecting portion 64 to the second position are opposite to each other. Viewing from a point of the fulcrum 56 of the second movable member 52, the first position of the projecting portion 64 is pretty far in an angle from the neutral position (an angle $\theta$ is large to some extent, for example, about 25° to 35°), but the second position is oriented in an almost same angle with the neutral position (an angle $\psi$ is smaller than the angle $\theta$, for example, about 3° to 8°). Positions of each component such as the coupling rod 29 and the fulcrum 56 are set in this manner. Accordingly, even when the lever portion 62 is moved from the neutral position to the second position, a rotation angle of the second movable member 52 rotated by that movement of the lever portion 62 is too small to change the state of the first spring 53.

Figure 10:
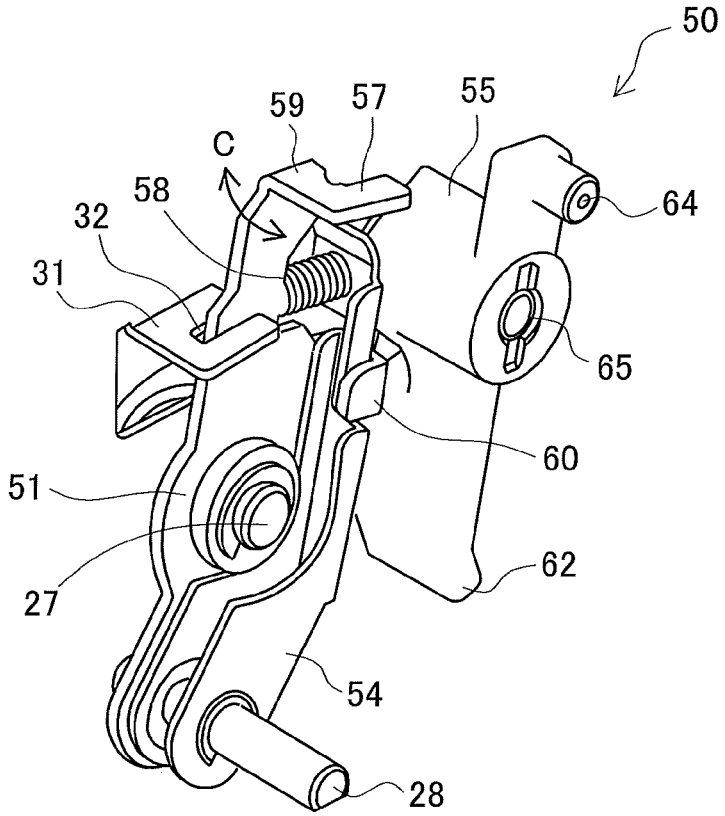
FIG. 10 is a perspective view of the holding mechanism in which components including the second movable member are removed from the view of FIG. 5.

Next, a configuration to prevent the first movable member 51 from falling sideways is explained. It has not been mentioned in the foregoing explanation, but the holding mechanism 50 is embedded with a configuration to prevent lateral falling. FIG. 10 is a view showing the holding mechanism 50 in which the second movable member 52 and the first spring 53 are removed from the mechanism 50 shown in FIG. 5. As shown in FIG. 10, a guide member 31 is provided inside the holding mechanism 50. The guide member 31 is provided with a slit 32. The guide member 31 is statically provided in the image forming apparatus 1. The holding mechanism 50 is configured such that a part of the first movable member 51 enters in the slit 32. The slit 32 allows rotation of the first movable member 51 about the support rod 28 but restricts lateral falling of the first movable member 51 in a direction intersecting the rotation movement (as indicated with an arrow C in FIG. 10).

The guide member 31 is thus enabled to prevent the first movable member 51 from falling sideways. The first movable member 51 is subjected to the elastic force of the first spring 53 and the second spring 59, and accordingly, there is a possibility that the member 51 is subjected to stress in the direction to fall sideways. However, the guide member 31 prevents such lateral falling, and hence the first movable member 51 and the support rod 28 have no necessity to be made excessively highly rigid. The guide member 31 may be provided in both of the holding mechanisms 50 and 70 shown in FIG. 3, or may be provided in either one of them.

As explained in detail above, according to the present embodiment, the image forming apparatus 1 includes the fixing unit 94, which is enabled to switch two levels, of the pressing force at the fixing nip, and the two levels of the pressing force are exerted by the two elastic members (the first spring 53 and the second spring 59). Further, in each level of the pressing force, either only one of the first spring 53 and the second spring 59 is made to apply the elastic force. Accordingly, it is achieved a fixing device and an image forming apparatus using the fixing device which can prevent excessive variations in the pressing force in each level among individual devices. Furthermore, the guide member 31 prevents the first movable member 51, which supports the pressure roller 97, from falling sideways.

While the present embodiment is given only for the purpose of illustration of the invention, the present invention is not limited to the embodiment. Accordingly, various changes and modifications may be made without departing from the scope of the invention. For example, in the above-mentioned embodiment, the pressing force at the fixing nip 95 in the first pressing state in FIG. 7 is made stronger than in the second pressing state in FIG. 8. Alternatively, the relation of the strength may be reversed (interchanged). Further, in the present embodiment, the first pressing state is realized with a tension spring (the first spring 53), and the second pressing state is realized with a compression spring (the second spring 59). Alternatively, the tension spring and the compression spring may be interchanged. As another alternative, both the springs may be tension springs, or may be compression springs. Furthermore, the strength of the pressing force may be realized by the total of spring rates of the first spring 53 or the second spring 59 and a lever ratio of each spring acting on the first movable member 51 (a point of effort is the spring hook 57 or the spring seat 58).

Further alternatively, the holding mechanism may be configured to switch the pressing force of three levels or more than three levels. The present invention is applicable to a monochrome printer or a copying machine besides a color printer shown in FIG. 1. As another alternative, the invention is applicable to a multifunction apparatus having a function of conducting transmission and reception of printing jobs through public lines.

In this fixing device, preferably, the operation lever is further configured to be switchable in positions of the first position, the second position, and a neutral position in which both the first elastic member and the second elastic member are made non-operative to press the second nip member, and the neutral position is located between the first position and the second position in an operation path of the operation lever. In the neutral position, removal of a jammed paper from the fixing device can be easily conducted. Further, the operation lever can directly move to the neutral position from either one of the first position and the second position without passing through the other one.

The fixing device, more preferably, includes a first movable member movably provided to hold the second nip member; a second movable member movably provided to hold the first elastic member with the first movable member; and a third movable member movably provided to hold the second elastic member with the first movable member, wherein the second movable member is configured to be switchable in positions of: an operative position in which the first elastic member presses the second nip member against the first nip member via the first movable member; and a non-operative position in which a pressing force by the first elastic member is inactive, the third movable member is configured to be switchable in positions of: an operative position in which the second elastic member presses the second nip member against the first nip member via the first movable member; and a non-operative position in which a pressing force by the second elastic member is inactive, the operation lever includes a first portion and a second portion, the first portion is configured to: place the second movable member in its operative position when the operation lever is in the first position; and place the second movable member in its non-operative position when the operation lever is out of the first position, and the second portion is configured to: place the third movable member in its operative position when the operation lever is in the second position; and place the third movable member in its non-operative position when the operation lever is out of the second position. The second movable member is configured to be in positions of the operative position in which the first elastic member presses the second nip member against the first nip member via the first movable member and the non-operative position in which the pressure of the first elastic member is made inactive, and the third movable member is configured to be in positions of the operative position in which the second elastic member presses the second nip member against the first nip member via the first movable member and the non-operative position in which the pressure by the second elastic member is made inactive. Further, the operation lever includes the first portion and the second portion. The first portion places the second movable member in the operative position when the operation lever is in the first position and places the second movable member in the non-operative position when the operation lever is out of the first position. Further, the second portion places the third movable member in the operative position when the operation lever is in the second position and places the third movable member in the non-operative position when the operation lever is out of the second position.

In the above configuration, when the operation lever is in the first position, the first portion of the operation lever places the second movable member in its operative position, and the second portion places the third movable member in its non-operative position. Thus, the fixing nip is only subjected to the pressing force by the first elastic member. On the other hand, when the operation lever is in the second position; the second portion of the operation lever places the third movable member in its operative position, and the first portion places the second movable member in its non-operative position. Thus, the fixing nip is only subjected to the pressing force by the second elastic member.

In the fixing device including the first to third movable members, preferably, the third movable member is placed on an opposite side of the first nip member with respect to the first movable member, the second elastic member is held and contracted from its free length between the first movable member and the third movable member, the first movable member is provided with a stopper portion to restrict movement of the third movable member moved by an elastic force of the second elastic member, the third movable member is in its non-operative position when the third movable member is pressed against the stopper portion by the elastic force of the second elastic member, and the third movable member is in its operative position when the third movable member is pressed against the first movable member by the second portion defying the elastic force of the second elastic member.

In the above configuration, when the operation lever is placed in the second position, the second portion of the operation lever pushes the third movable member against the first movable member defying the elastic force of the second elastic member. This position of the third movable member in the thus pushed state is the operative position of the third movable member, and the elastic force of the second elastic member acts on the fixing nip via the first movable member. When the operation lever is out of the second position, the third movable member is free from pushing by the second portion, and thus the third movable member moves to be pressed against the stopper portion by the elastic force of the second elastic member. This position of the third movable member which is pressed against the stopper portion is the non-operative position of the third movable member. In this state, the stopper portion which is a part of the first movable member restricts an opposite end of the second elastic member to move. The elastic force of the second elastic member is thus kept in balance and canceled out in the first movable member, so that the elastic force fails to act on the fixing nip.

In the fixing device including the first movable member having the stopper portion, preferably, the first movable member and the third movable member are rotatably provided about a common axis. The configuration of the fixing device can be thus simplified.

In the fixing device including the first to third movable members, further preferably, the first elastic member is placed on a side close to the first nip member with respect to the first movable member and hung between the first movable member and the second movable member, and the second movable member is configured to elongate the first elastic member from its free length in the operative position and not to elongate the first elastic member from its free length in the non-operative position.

In the above configuration, when the operation lever is moved to the first position, the second movable member is moved to the operative position by the first portion of the operation lever. In this state, the first elastic member is elongated from its free length, and the first elastic member therefore urges the first movable member with the elastic force to return to its original free length. In this manner, the fixing nip is subjected to the pressing force. When the operation lever is out of the first position, the second movable member is moved to the non-operative position. In this state, the first elastic member is maintained in its free length and generates no elastic force. Accordingly, the fixing nip is not subjected to the pressing force.

In the fixing device including the first to third movable members, further preferably, the fixing device further includes a guide member to guide a movement of the first movable member, the guide member is configured to: allow the first movable member to move in a press-release direction to press the second nip member against the first nip member and to release the press-contact state; and restrict the movement of the first movable member in directions other than the press-release direction. In this fixing device, the first movable member, which is subjected to the elastic force of the first elastic member or the second elastic member, could be subjected to pressure to fall down in directions other than an aimed moving direction. The guide member prevents such an unintended falling of the first movable member.

An image forming apparatus according to another aspect of the invention includes an image forming unit to carry a toner image on a recording medium; and a fixing unit to fix the toner image on the recording medium having the toner image carried thereon in the image forming unit, wherein the fixing unit is the fixing device according to claim 1. The fixing unit is the fixing device in any one of the above configurations.

REFERENCE SIGNS LIST

1 Image forming apparatus
2Y, 2M, 2C, 2K Imaging unit
27 Shaft of a pressure roller
28 Support rod
29 Coupling rod
30 First transfer roller
31 Guide member
32 Slit
50 Holding mechanism
51 First movable member
52 Second movable member
53 First spring
54 Third movable member
55 Operation member
59 Second spring
60 Wall portion (stopper portion)
62 Lever portion
63 Long hole
64 Projecting portion
65 Rod mounting hole
66 Protrusion
70 Holding mechanism
71 First movable member
72 Second movable member
73 First spring
74 Third movable member
75 Operation member
94 Fixing unit
95 Fixing nip
96 Fixing roller
97 Pressure roller

What is claimed is:

1. A fixing device including a first nip member and a second nip member pressed against the first nip member, the fixing device being configured to pass a recording medium carrying a toner image thereon through a nip portion formed by the first nip member and the second nip member and to fix the toner image on the recording medium, wherein the fixing device further includes:

a first elastic member and a second elastic member to press the second nip member against the first nip member; and an operation lever to change a pressing state of the second nip member against the first nip member by the first elastic member and the second elastic member, the operation lever is configured to be switchable in positions of:

a first position in which the first elastic member is made operative to press the second nip member and the second elastic member is made non-operative, a second position in which the second elastic member is made operative to press the second nip member and the first elastic member is made non-operative, and a neutral position in which both the first elastic member and the second elastic member are made non-operative to press the second nip member, and wherein a pressing force of the second nip member against the first nip member in the first position is different from a pressing force of the second nip member against the first nip member in the second position.

2. The fixing device according to claim 1, wherein the neutral position is located between the first position and the second position in an operation path of the operation lever.

3. The fixing device according to claim 1 including:

a first movable member movably provided to hold the second nip member;

a second movable member movably provided to hold the first elastic member with the first movable member; and a third movable member movably provided to hold the second elastic member with the first movable member, wherein the second movable member is configured to be switchable in positions of:

an operative position in which the first elastic member presses the second nip member against the first nip member via the first movable member; and a non-operative position in which a pressing force by the first elastic member is inactive, the third movable member is configured to be switchable in positions of:

an operative position in which the second elastic member presses the second nip member against the first nip member via the first movable member; and a non-operative position in which a pressing force by the second elastic member is inactive, the operation lever includes a first portion and a second portion, the first portion is configured to:

place the second movable member in its operative position when the operation lever is in the first position; and place the second movable member in its non-operative position when the operation lever is out of the first position, and the second portion is configured to:

place the third movable member in its operative position when the operation lever is in the second position; and place the third movable member in its non-operative position when the operation lever is out of the second position.

4. The fixing device according to claim 2 including:

a first movable member movably provided to hold the second nip member;

a second movable member movably provided to hold the first elastic member with the first movable member; and a third movable member movably provided to hold the second elastic member with the first movable member, wherein the second movable member is configured to be switchable in positions of:

an operative position in which the first elastic member presses the second nip member against the first nip member via the first movable member; and a non-operative position in which a pressing force by the first elastic member is inactive, the third movable member is configured to be switchable in positions of:

an operative position in which the second elastic member presses the second nip member against the first nip member via the first movable member; and a non-operative position in which a pressing force by the second elastic member is inactive, the operation lever includes a first portion and a second portion, the first portion is configured to:

place the second movable member in its operative position when the operation lever is in the first position; and place the second movable member in its non-operative position when the operation lever is out of the first position, and the second portion is configured to:

place the third movable member in its operative position when the operation lever is in the second position; and place the third movable member in its non-operative position when the operation lever is out of the second position.

5. The fixing device according to claim 3, wherein the third movable member is placed on an opposite side of the first nip member with respect to the first movable member, the second elastic member is held and contracted from its free length between the first movable member and the third movable member, the first movable member is provided with a stopper portion to restrict movement of the third movable member moved by an elastic force of the second elastic member, the third movable member is in its non-operative position when the third movable member is pressed against the stopper portion by the elastic force of the second elastic member, and the third movable member is in its operative position when the third movable member is pressed against the first movable member by the second portion defying the elastic force of the second elastic member.

6. The fixing device according to claim 4, wherein the third movable member is placed on an opposite side of the first nip member with respect to the first movable member, the second elastic member is held and contracted from its free length between the first movable member and the third movable member, the first movable member is provided with a stopper portion to restrict movement of the third movable member moved by an elastic force of the second elastic member, the third movable member is in its non-operative position when the third movable member is pressed against the stopper portion by the elastic force of the second elastic member, and the third movable member is in its operative position when the third movable member is pressed against the first movable member by the second portion defying the elastic force of the second elastic member.

7. The fixing device according to claim 5, wherein the first movable member and the third movable member are rotatably provided about a common axis.

8. The fixing device according to claim 6, wherein the first movable member and the third movable member are rotatably provided about a common axis.

9. The fixing device according to claim 3, wherein the first elastic member is placed on a side close to the first nip member with respect to the first movable member and hung between the first movable member and the second movable member, and the second movable member is configured to elongate the first elastic member from its free length in the operative position and not to elongate the first elastic member from its free length in the non-operative position.

10. The fixing device according to claim 5, wherein the first elastic member is placed on a side close to the first nip member with respect to the first movable member and hung between the first movable member and the second movable member, and the second movable member is configured to elongate the first elastic member from its free length in the operative position and not to elongate the first elastic member from its free length in the non-operative position.

11. The fixing device according to claim 7, wherein the first elastic member is placed on a side close to the first nip member with respect to the first movable member and hung between the first movable member and the second movable member, and the second movable member is configured to elongate the first elastic member from its free length in the operative position and not to elongate the first elastic member from its free length in the non-operative position.

12. The fixing device according to claim 3, wherein the fixing device further includes a guide member to guide a movement of the first movable member, the guide member is configured to:

allow the first movable member to move in a press-release direction to press the second nip member against the first nip member and to release the press-contact state; and restrict the movement of the first movable member in directions other than the press-release direction.

13. The fixing device according to claim 5, wherein the fixing device further includes a guide member to guide a movement of the first movable member, the guide member is configured to:

allow the first movable member to move in a press-release direction to press the second nip member against to the first nip member and to release the press-contact state; and restrict the movement of the first movable member in directions other than the press-release direction.

14. The fixing device according to claim 7, wherein the fixing device further includes a guide member to guide a movement of the first movable member, the guide member is configured to:

allow the first movable member to move in a press-release direction to press the second nip member against to the first nip member and to release the press-contact state; and restrict the movement of the first movable member in directions other than the press-release direction.

15. The fixing device according to claim 9, wherein the fixing device further includes a guide member to guide a movement of the first movable member, the guide member is configured to:

allow the first movable member to move in a press-release direction to press the second nip member against to the first nip member and to release the press-contact state; and restrict the movement of the first movable member in directions other than the press-release direction.

16. An image forming apparatus including:

an image forming unit to carry a toner image on a recording medium; and a fixing unit to fix the toner image on the recording medium having the toner image carried thereon in the image forming unit, wherein the fixing unit is the fixing device according to claim 1.

17. The image forming apparatus according to claim 16, wherein the operation lever is further configured to be switchable in positions of the first position, the second position, and a neutral position in which both the first elastic member and the second elastic member are made non-operative to press the second nip member, and the neutral position is located between the first position and the second position in an operation path of the operation lever.

18. The image forming apparatus according to claim 16 including:

a first movable member movably provided to hold the second nip member;

a second movable member movably provided to hold the first elastic member with the first movable member; and a third movable member movably provided to hold the second elastic member with the first movable member, wherein the second movable member is configured to be switchable in positions of:

an operative position in which the first elastic member presses the second nip member against the first nip member via the first movable member; and a non-operative position in which a pressing force by the first elastic member is inactive, the third movable member is configured to be switchable in positions of:

an operative position in which the second elastic member presses the second nip member against the first nip member via the first movable member; and a non-operative position in which a pressing force by the second elastic member is inactive, the operation lever includes a first portion and a second portion, the first portion is configured to:

place the second movable member in its operative position when the operation lever is in the first position; and place the second movable member in its non-operative position when the operation lever is out of the first position, and the second portion is configured to:

place the third movable member in its operative position when the operation lever is in the second position; and place the third movable member in its non-operative position when the operation lever is out of the second position.

19. The image forming apparatus according to claim 18, wherein the third movable member is placed on an opposite side of the first nip member with respect to the first movable member, the second elastic member is held and contracted from its free length between the first movable member and the third movable member, the first movable member is provided with a stopper portion to restrict movement of the third movable member moved by an elastic force of the second elastic member, the third movable member is in its non-operative position when the third movable member is pressed against the stopper portion by the elastic force of the second elastic member, and the third movable member is in its operative position when the third movable member is pressed against the first movable member by the second portion defying the elastic force of the second elastic member.

20. The image forming apparatus according to claim 19, wherein the first movable member and the third movable member are rotatably provided about a common axis.

* * * * *